US005931540A

United States Patent [19]

Merten et al.

[11] Patent Number: 5,931,540

[45] Date of Patent: Aug. 3, 1999

[54] DRIVE SYSTEM HAVING A PIN DRIVE CHAIN FOR A CUTTING MACHINE FOR UNDERGROUND MINING

[75] Inventors: Gerhard Merten; Frank Fischer, both of Lünen; Jörg Wirtz, Kamen, all of Germany

[73] Assignee: DBT Deutsche Bergbau-Technik GmbH, Germany

[21] Appl. No.: 08/906,510

[22] Filed: Aug. 5, 1997

[30] Foreign Application Priority Data

Aug. 20, 1996 [DE] Germany ..... 196 33 492

[51] Int. Cl.[6] ..... E21C 29/06; E21C 29/02

[52] U.S. Cl. ..... 299/1.6; 299/43

[58] Field of Search ..... 299/43, 34.09, 299/34.1, 1.6, 50

[56] References Cited

U.S. PATENT DOCUMENTS 4,298,231 11/1981 Spence et al. ..... 299/50

FOREIGN PATENT DOCUMENTS

| | | | |
|---|---|---|---|
| 2829011 | 11/1979 | Germany . | |
| 2938446 | 4/1981 | Germany . | |
| 2938408 | 7/1982 | Germany . | |
| 3622110 | 6/1995 | Germany . | |
| 4423925 | 1/1996 | Germany . | |
| 543750 | 1/1977 | U.S.S.R. | 299/1.6 |
| 2050282 | 1/1981 | United Kingdom | 299/43 |

*Primary Examiner*—David J. Bagnell
*Attorney, Agent, or Firm*—Vickers, Daniels & Young

[57] ABSTRACT

In the drive system according to the invention for a cutting machine which can be moved along a chain conveyor and has a pin drive chain arranged in a chain receptacle of the chain conveyor, the pin drive chain is attached at each of its two ends to a hydraulic tensioning cylinder device, with the aid of which the chain slackness which forms in the pin drive chain can be compensated. At the same time, holding devices, such as end stops, are provided in the region of the tensioning cylinder devices, which holding devices support or fix the chain section of the pin drive chain which is respectively under tensile loading.

12 Claims, 2 Drawing Sheets

DRIVE SYSTEM HAVING A PIN DRIVE CHAIN FOR A CUTTING MACHINE FOR UNDERGROUND MINING

FIELD OF THE INVENTION

The invention relates to a drive system for a cutting machine of the type used for underground mining, in particular a drum shearing machine or a coal auger, which can be moved along an advanceable chain conveyor, for underground excavation, having a pin drive chain which is arranged so as to be longitudinally movable along the chain conveyor in a chain receptacle thereof and with which the cutting machine is engaged with at least one chain wheel driven by its travelling drive and which is coupled at its chain ends to the chain conveyor.

BACKGROUND OF THE INVENTION

Drive systems of the type referred to above using a pin drive chain arranged on the face conveyor and laid in a chain duct have been known in numerous designs for a long time and are customary in underground coal mining (DE 36 22 110 C2, DE 29 38 408 C2, DE 29 38 408 C2, DE 44 23 925 A1, DE 29 38 446 A1, DE 28 29 011 B1). In this case, it is usual to attach the pin drive chain, arranged along the chain conveyor in a chain duct which is open at the top, by its chain ends to the conveyor in the end regions thereof. During travelling and excavation operation of the cutting machine which is guided along the face conveyor and straddles the latter in the manner of a portal, the chain section of the pin drive chain which lies in front of the cutting machine in the direction of travel thereof is subjected to tensile loading and is consequently held taut in its course, whereas the chain may be slack in the chain section of the pin drive chain located behind the cutting machine. In view of the usually curved course of the face conveyor, this may also lead to wear on the chain and its guiding and possibly also to malfunctions.

SUMMARY OF THE INVENTION

The object of the invention is, in a cutting machine drive system having a pin drive chain, to avoid the abovementioned chain slackness which occurs in the pin drive chain when the cutting machine is being used for excavation.

According to the invention, this object may be achieved in that the pin drive chain is, or can be coupled, at each of its two ends to a hydraulic tensioning cylinder device which eliminates the chain slackness by tensioning, and in that holding devices or the like, which support the section of the pin drive chain which is respectively under tensile loading are arranged in the region of the tensioning cylinder devices.

In the drive system according to the invention, with the aid of the tensioning cylinder devices, the chain slackness which forms in the pin drive chain behind the cutting machine during the excavation run of the latter can be eliminated, and the pin drive chain can be reliably held under tension in this section of its length without the curved course of the chain conveyor used as a face conveyor and its loop formation while advancing in the mining direction being impeded. This removes or ameliorates the problems associated with the formation of chain slackness, and disturbance-free operation of the cutting machine may be ensured in both operating directions thereof. The tensile forces induced by the cutting machine in the chain section of the pin drive chain located in the direction of travel of the cutting machine while it is travelling uphill or downhill do not need to be absorbed by the tensioning cylinder devices since the pin drive chain can be supported with the chain section, which is under tensile loading, at the end on a separate holding device. Simple mechanical end stops, which are fixedly arranged on the chain conveyor, are preferably used for the holding devices.

Preferably guide pieces which are guided on guides in the tensioning direction of the pin drive chain are arranged on the end sections of the pin drive chain. In this case, the arrangement can be designed in a simple manner so that the guide pieces are provided with guide projections which are guided in slot guides. The hydraulic tensioning cylinders of the tensioning cylinder devices may be attached to the guide pieces in joint connections, the guides of the guide pieces forming restrictions on the tensioning path.

In a preferred embodiment of the invention, the end stops form stop surfaces for the guide pieces, at which the chain ends of the pin drive chain are connected to the tensioning cylinder devices. Moreover, the guide pieces may comprise simple sliding pieces which are guided on sliding surfaces which are formed by the conveyor or attachment parts thereof.

In general, the pin drive chain runs over the entire length of the chain conveyor which may have drive stations forming the main and auxiliary drive at its two ends. In particular when the arrangement of the tensioning cylinder device or devices at the end of the chain conveyor causes problems due to the conveyor drive located there, in a further refinement of the invention the pin drive chain may be provided at one of its ends or else at both of its ends with a chain section which is deflected into the opposite course over a deflecting means, such as for example a fixed curve deflecting means or a deflection wheel, to which chain section the relevant tensioning cylinder device is assigned which cylinder can, in this case, be arranged favourably in terms of space, in particular, on the stowing side of the chain conveyor. The deflected end section of the pin drive chain may be formed by the latter itself or even by a round link chain section which can be guided around the deflection with a tight loop.

One aspect of the invention also provides an arrangement in which the hydraulic tensioning cylinder devices are controlled by a cylinder control assigned to them in accordance with the direction of travel of the cutting machine in such a way that in each case only that hydraulic tensioning cylinder device is acted upon hydraulically in the tensioning direction which, in the two directions of travel of the cutting machine, is assigned to that chain section of the pin drive chain in which the chain slackness can occur.

The invention is explained in greater detail below in conjunction with the exemplary embodiment shown in the drawing.

DETAILED DESCRIPTION OF THE EMBODIMENT

To understand the invention, reference is made to the pertinent state of the art, such as emerges from the publications mentioned at the beginning.

Figure 1:
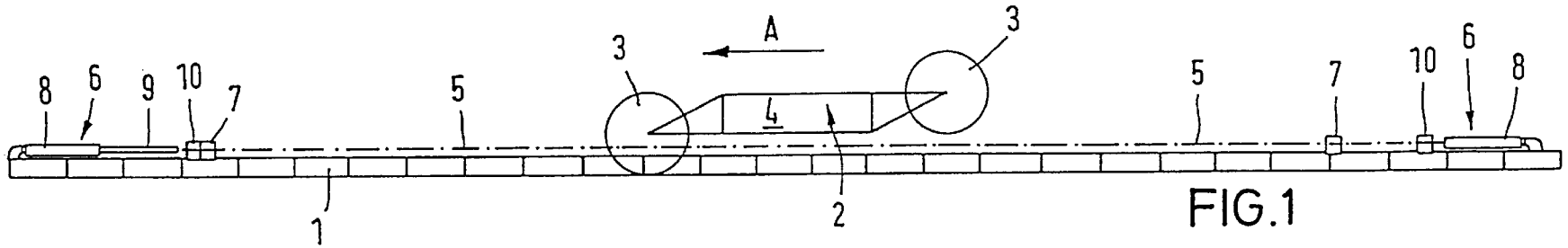
FIG. 1 shows, in a very diagrammatic simplification, a side view of an underground excavation and conveying apparatus with a chain conveyor used as a face conveyor and a drum shearing machine together with the pin drive chain, arranged on the conveyor, and the tensioning cylinder devices of the pin drive chain which are provided according to the invention.

FIG. 1 shows, in a very diagrammatic simplification, a chain conveyor 1 which is installed in the underground excavation face, the conveyor drives arranged at the two ends thereof and forming the main and auxiliary drives having been omitted. The chain conveyor 1 forming the face conveyor comprises in the usual manner individual conveyor pans which are connected to one another with slight vertical and horizontal movement and so as to be resistant to tension, so that a curved movement of the conveyor is possible in adaptation to the course of the floor and also in adaptation to the course of the excavation or coal face, and the conveyor can be advanced, as is customary, in a loop behind the cutting machine with the aid of the advancing cylinder devices. The cutting machine 2 guided longitudinally along the conveyor 1 comprises in a known manner a drum shearing machine with the driven shearing rollers 3 which can be pivoted up. On its machine body 4 which straddles the conveying chute of the chain conveyor 1 in the manner of a portal and is guided on both sides of the chain conveyor, the drum shearing machine has a travelling drive which is provided with at least one drivable driving chain wheel which cooperates with a pin drive chain 5. The pin drive chain 5 is located, as is customary, in a chain duct which forms a chain receptacle, is generally attached to the stowing side of the chain conveyor, and is open on its upper side for the engagement of the driven chain wheel of the cutting machine 2.

Drive systems for drum shearing machines using a pin drive chain are generally known, thus obviating the need for a detailed explanation.

As is shown in FIG. 1, the pin drive chain 5 is connected at its two chain ends, which are located in the end regions of the chain conveyor 1, to a hydraulic tensioning cylinder device 6 which is attached to the end of the conveyor. It can be seen in FIG. 1 that, when the direction of travel of the cutting machine 2 is in the direction of the arrow A, the chain section of the pin drive chain which is located in front of the cutting machine in this direction of travel is subjected to tensile loading due to the drive engagement of the driven driving wheel of the travelling drive of the cutting machine and is thus held under tension, while the chain section of the pin drive chain 5 located behind the cutting machine in the direction of travel A is not subjected to tensile loading by the travelling drive of the cutting machine but, in contrast, the chain may be slack in this chain section due to the drive movement of the cutting machine, which is undesirable. In order to eliminate this chain slackness in the relevant chain section of the pin drive chain 5 and likewise to hold this chain section under tension, the chain section is tensioned with the aid of the tensioning cylinder device 6 respectively assigned to this chain section (in FIG. 1 the tensioning cylinder device shown on the right), while the tensioning cylinder device 6 located at the other end, in FIG. 1 at the left-hand end, of the pin drive chain, does not need to be set to hydraulic chain tensioning since the pin drive chain is fixed by its relevant end on a holding device 7 arranged on the conveyor.

When the cutting machine 2 is moving counter to the direction of travel A, the chain section of the pin drive chain 5 located, in this direction of travel, between the cutting machine 2 and the tensioning cylinder device 6 shown on the right in the figure is held under tension by the travelling drive of the cutting machine, while the chain section behind the cutting machine undergoes the formation of chain slackness with respect to the tensioning cylinder device 6 shown on the left in the figure, due to the travelling drive of the cutting machine, which chain slackness, however, is eliminated by the said tensioning cylinder device 6.

Figure 2:
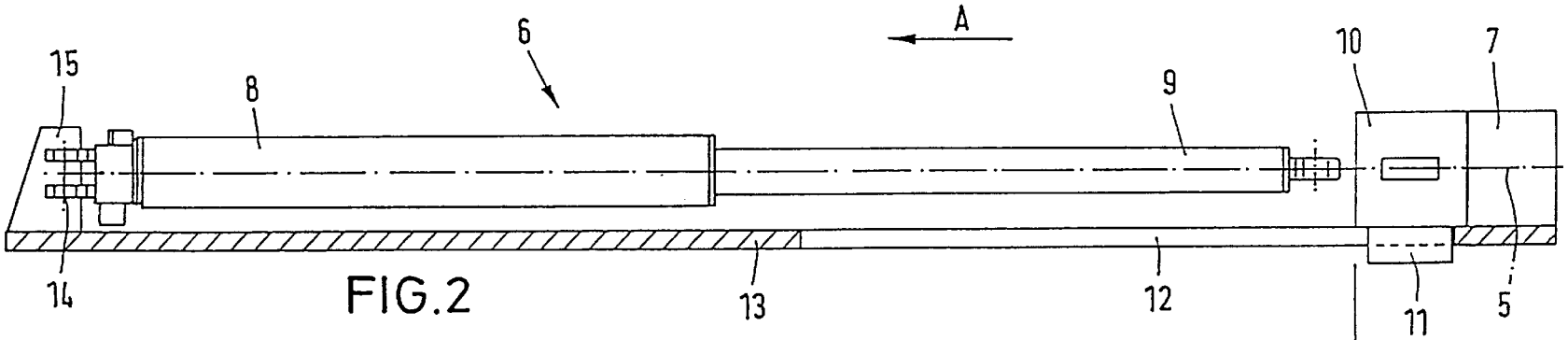
FIGS. 2 and 3 each show, in a simplified side view, one of the two tensioning cylinder devices shown in FIG. 1 during the movement of the drum shearing machine in the direction towards the said tensioning cylinder device (FIG. 2) and during the opposite operating movement of the cutting machine (FIG. 3)
Figure 3:
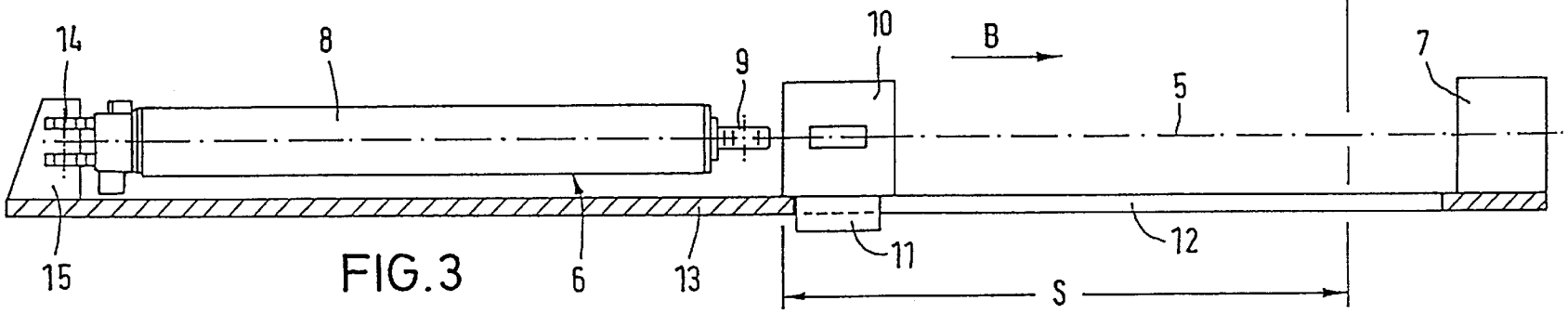

Details of the tensioning cylinder devices can be seen in FIGS. 2 and 3. The above mentioned holding device 7, which is formed by an end stop fixedly arranged or mounted on the conveyor, can be seen. The hydraulic tensioning cylinder 8 can be or is attached by its piston rod 9 to a guide piece 10 in a joint, expediently a pin joint. In the exemplary embodiment shown, the guide piece 10 comprises a sliding piece which is guided by a guide projection 11 in a slot guide 12 which limits the tensioning path S, the guide piece being guided on both sides of this slot guide 12 on a sliding surface which is formed by a component 13 having the slot guide 12. On this component, the tensioning cylinder 8 is connected in the connection joint 14 to a fixed bracket 15 with spacing from the slot guide 12. Moreover, the holding device 7 formed by the mechanical stop can be fixedly arranged on the component 13.

In FIG. 2, it is assumed that the cutting machine 2 is moving in the direction of the arrow A towards the tensioning cylinder device 6 shown, and consequently the chain section of the pin drive chain between the cutting machine 2 and the said tensioning cylinder device 6 is held taut by the travelling drive of the cutting machine. In this state of operation, the pin drive chain 5 which is connected to the guide piece 10 located here so as to be resistant to tension is supported on the fixed stop of the holding device 7, so that the pin drive chain is fixed on the chain end towards which the cutting machine 2 is running. In this case, the hydraulic tensioning cylinder 8 is inactive, that is to say does not need to be acted upon hydraulically to tension the pin drive chain. The pin drive chain 5 can be passed with its end section through a passage in the holding device 7 and attached behind the latter to the relevant guide piece 10.

FIG. 3 shows the situation with the opposite movement of the cutting machine 2 in the direction of the arrow B. During this movement, the cutting machine 2 moves away from the tensioning cylinder device 6 shown, so that the chain may become slack in the section of the pin drive chain 5 between the said tensioning cylinder device and the cutting machine. In order to eliminate this chain slackness and to hold the said chain section of the pin drive chain 5 under chain tension, the hydraulic tensioning cylinder 8 is acted upon hydraulically in the direction of retraction of its piston rod 9, so that it pulls the guide piece 10, to which the pin drive chain 5 is attached, counter to the direction of the arrow B, guided along the slot guide 12, off the end stop of the holding device 7 and thus pulls out the chain slackness on the said chain section, so that this chain section is held under a set chain tension behind the cutting machine. It is obvious that, even in the arrangement according to FIG. 3, the tensioning cylinder 8 is attached to the guide piece 10 by its piston rod 9 in order to carry the guide piece 10 along counter to the direction of the arrow B for chain tensioning.

It thus emerges from the above that, in each of the two directions of travel of the cutting machine 2 in the direction of the arrow A or in the direction of the arrow B, in each case only one of the two tensioning cylinder devices 6 from which the cutting machine 2 is moving away is active in order to hold the relevant chain section of the pin drive chain 5 under a set chain tension and thus to avoid the formation of chain slackness. The two tensioning cylinder devices 6 can be controlled by a cylinder control in accordance with the respective direction of travel of the cutting machine 2, so that manual control of the tensioning cylinder devices with the cutting machine running in excavation mode is not required.

Figure 4:
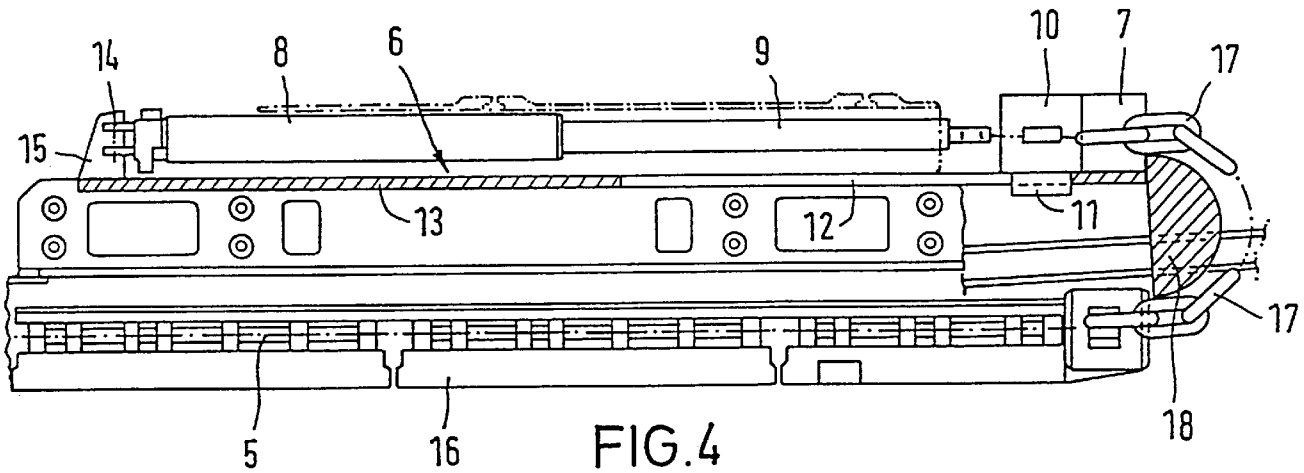
FIG. 4 shows, in a plan view, a modified embodiment of the tensioning cylinder device used in the drive system according to the invention, the assigned drive head at the end of the chain conveyor being omitted for reasons of clarity.

When, for example, the arrangement of the tensioning cylinder devices 6 or one of the latter at the relevant end of the chain conveyor 1 is not possible, or is only possible under great difficulty, for reasons of space owing to the conveyor drive being located there, the pin drive chain 5 can be deflected at this end over a deflecting means, for example by about 180° in the opposite direction, so that the tensioning cylinder devices 6 can be accommodated favourably in terms of space on the stowing side of the chain conveyor. Such an arrangement is shown in FIG. 4. It can be seen that the pin drive chain 5, as is known, is arranged in a chain duct 16 which extends in the longitudinal direction of the chain conveyor, is attached thereto, and is open on its upper side for the engagement of the driving chain wheel of the cutting machine 2. In this case, at its end, i.e. at the end of the conveyor, the pin drive chain 5 is deflected with an end chain section 17 over a deflecting means 18 by about 180° into the opposite course and is coupled to the tensioning cylinder device 6 located here, which in this case is located on the stowing side of the conveyor. In the exemplary embodiment shown, the deflecting means 18 is formed by a fixed curve deflecting means over which the end section 17 of the pin drive chain 5 slides. However, the deflecting means 18 can instead also be formed by a rotatable deflection wheel arranged here. The holding device 7 designed as a fixed stop is arranged behind the deflecting means 18 on the conveyor or an attachment part thereof and, in the same manner, forms a stop for the guide piece 10 which is formed by a sliding piece and to which the end section 17 as well as the piston rod 9 of the tensioning cylinder 8 are attached. Here, too, the end section 17 can be guided through a passage in the holding device 7 or moved laterally past the latter. The end section 17 of the pin drive chain 5 may be formed by its own end, but preferably comprises a chain section of a round link chain with a small chain division, which section is connected to the end of the pin drive chain 5 and can be guided in a narrow curve around the deflecting means 18.

It is obvious that either just one of the two tensioning cylinder devices 6 or else both tensioning cylinder devices 6 can be designed with an end deflection of the pin drive chain. The mode of operation of the tensioning cylinder devices with a deflection is otherwise the same as in the design according to FIGS. 2 and 3, in which the tensioning cylinder devices 6 are arranged without a deflection in the longitudinal course of the pin drive chain 5. With the aid of the tensioning cylinder devices 6, as described above, the chain slackness behind the cutting machine is compensated or eliminated in excavation mode, but without impeding the curved course of the chain conveyor and its looping advancement in sections.

Numerous modifications are possible from that which has been described without departing from the scope of the invention.

We claim:

1. A drive system for a cutting machine which can be moved along an advanceable chain conveyor, for underground excavation, said cutting machine having a driven chain wheel and said conveyor having a chain receptacle extending along its length;

said drive system comprising:

a pin drive chain having two ends, said pin drive chain being disposed in said chain receptacle of said conveyor and being engageable by said chain wheel of said cutting machine whereby the cutting machine can be driven in either direction along said conveyor with one end of the chain under driving tension and the other end slack;

hydraulic tensioning devices for the respective ends of said pin drive chain; and respective holding devices associated with said hydraulic tensioning devices;

said hydraulic tensioning devices being operable to tension respective ends of said pin drive chain when slack, and said holding devices operable to hold said pin drive chain against said driving tension.

2. A drive system according to claim 1, wherein said holding devices are fixed end stops.

3. A drive system according to claim 1, comprising guide pieces and guides, said guide pieces being guided on said guides and arranged on said ends of said pin drive chain.

4. A drive system according to claim 3, wherein said guide pieces are provided with guide projections, and said guide has slot guides in which said guide projections are guided.

5. A drive system according to claim 3, wherein said tensioning cylinder devices are attached to respective ones of said guide pieces.

6. A drive system according to claim 3, wherein said holding devices are fixed end stops, and said guide pieces are provided with corresponding stop surfaces.

7. A drive system according to claim 3, wherein said guide pieces comprise sliding pieces which are guided on sliding surfaces.

8. A drive system according to claims 1, wherein said holding devices are provided with passages through which end chain sections of the pin drive chain can extend.

9. A drive system according to claim 1, comprising at least one deflecting means for a respective end of said chain, said respective chain end being deflected around said deflecting means to reverse its direction.

10. A drive system according to claim 9, wherein said at lease one chain end section comprises a round link chain section.

11. A drive system according to claim 9, wherein both ends of said chain are deflected around respective deflecting means to reverse their direction.

12. A drive system according to claim 9, wherein said deflecting means is a fixed curve deflector.

* * * * *